US005671485A

United States Patent [19]

Middlestead

[11] Patent Number: 5,671,485

[45] Date of Patent: Sep. 30, 1997

[54] SUPPORT DEVICE FOR EMPTYING COLOSTOMY BAG

[76] Inventor: Robert E. Middlestead, HC #3 Box 78, Tionesta, Pa. 16353

[21] Appl. No.: 536,625

[22] Filed: Sep. 29, 1995

[51] Int. Cl.[6] ..... E03D 9/00

[52] U.S. Cl. ..... 4/315; 4/341; 4/661; 248/99

[58] Field of Search ..... 4/144.1, 144.2, 4/231, 245.3, 301, 315, 420.3, 445, 484, 661, 666, 341; 604/332; 141/331, 390, 391; 248/94, 99

[56] References Cited

U.S. PATENT DOCUMENTS

| | | | |
|---|---|---|---|
| 484,459 | 10/1892 | Reynolds | 248/94 |
| 851,873 | 4/1907 | Eagleton | 248/94 |
| 1,241,573 | 10/1917 | Svaren | 248/94 |
| 2,660,772 | 12/1953 | Ehrhardt | 4/666 X |
| 2,801,424 | 8/1957 | Mercer | 4/301 X |
| 4,285,076 | 8/1981 | Dickstein | 4/341 |

*Primary Examiner*—Robert M. Fetsuga
*Attorney, Agent, or Firm*—Harry I. Leon

[57] ABSTRACT

A device which is specifically adapted to support a colostomy bag over the opening of a toilet. This device, which facilitates the cleaning of the bag by a user or a care giver, includes a support formed from a metallic wire. This metallic wire support has a first grasping end, a second grasping end and a circular spring formed therebetween. The first grasping end is adapted to removably grasp one rim of a toilet. Oppositely positioned from the first grasping end is a second grasping end. The second grasping end is adapted to removably grasp the opposite rim of the toilet. The centrally disposed spring functions to support the upper end of a colostomy bag. Thus what has been described is a device which can support a colostomy bag over the opening of a toilet.

4 Claims, 4 Drawing Sheets

FIG 1
PRIOR ART
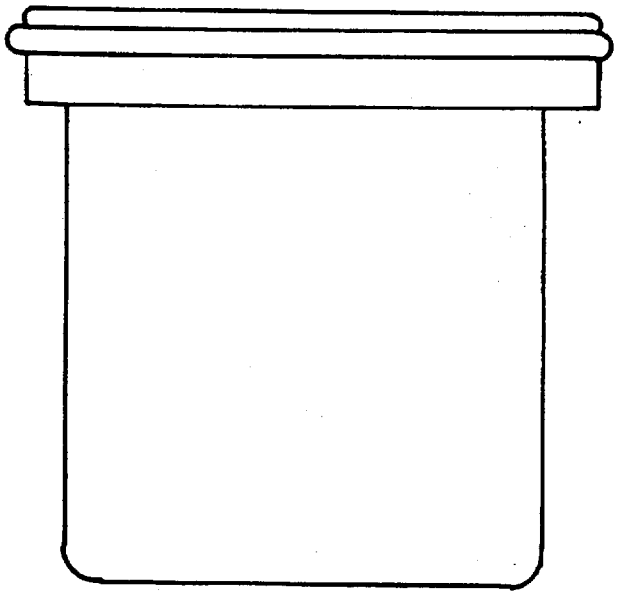
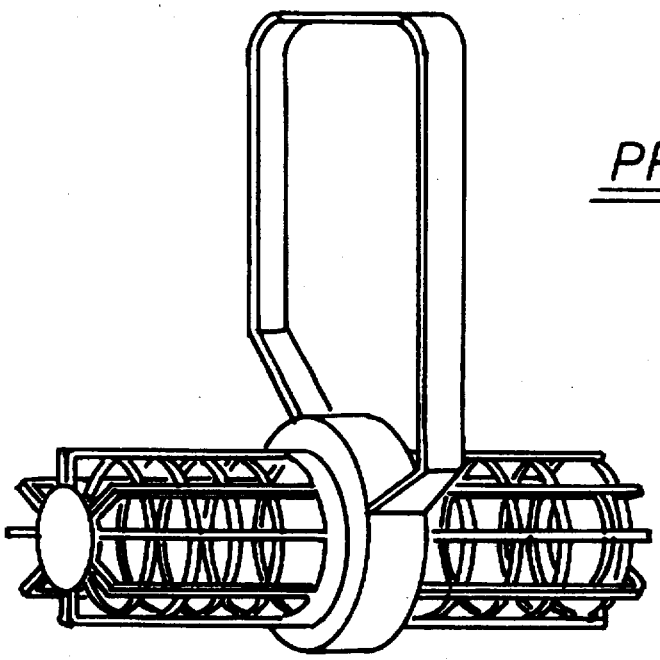
FIG 2
PRIOR ART

*Fig. 5.*
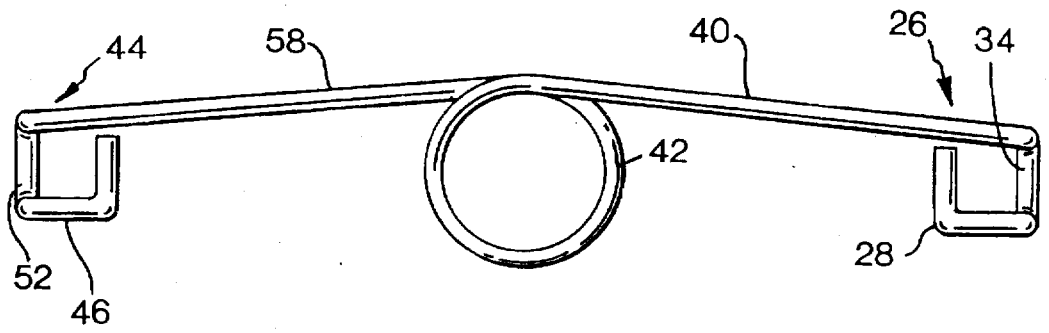
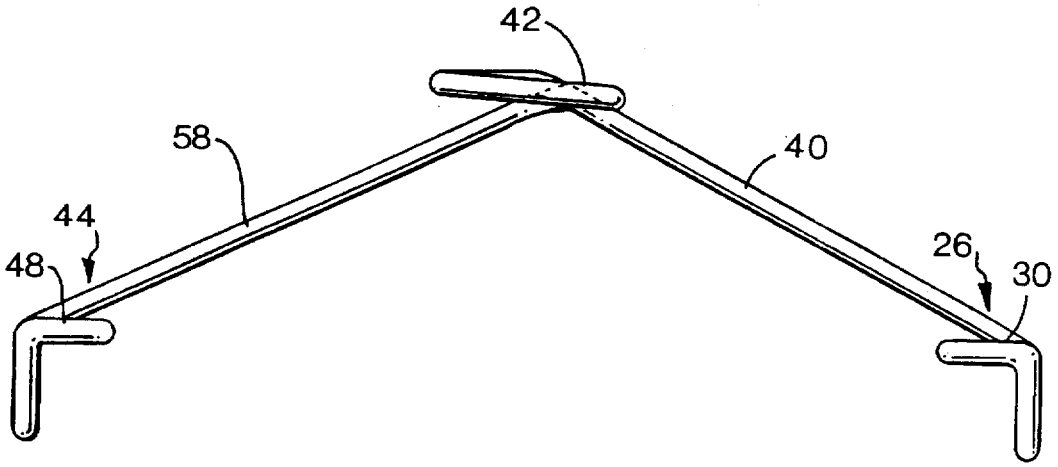
*Fig. 6.*

Fig. 7.
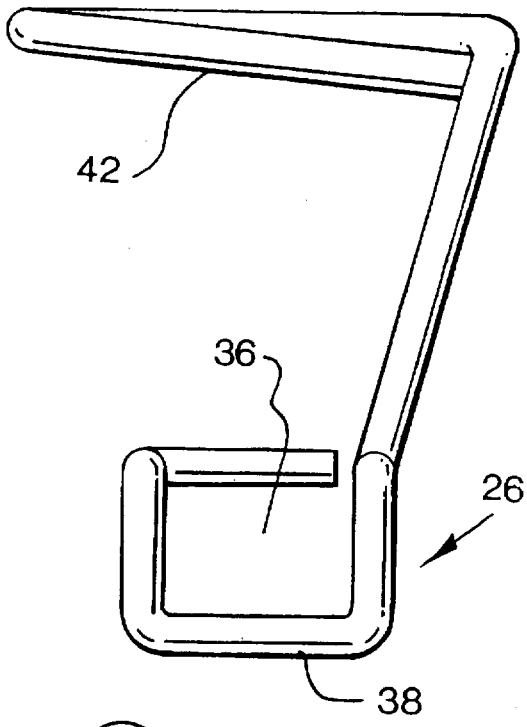
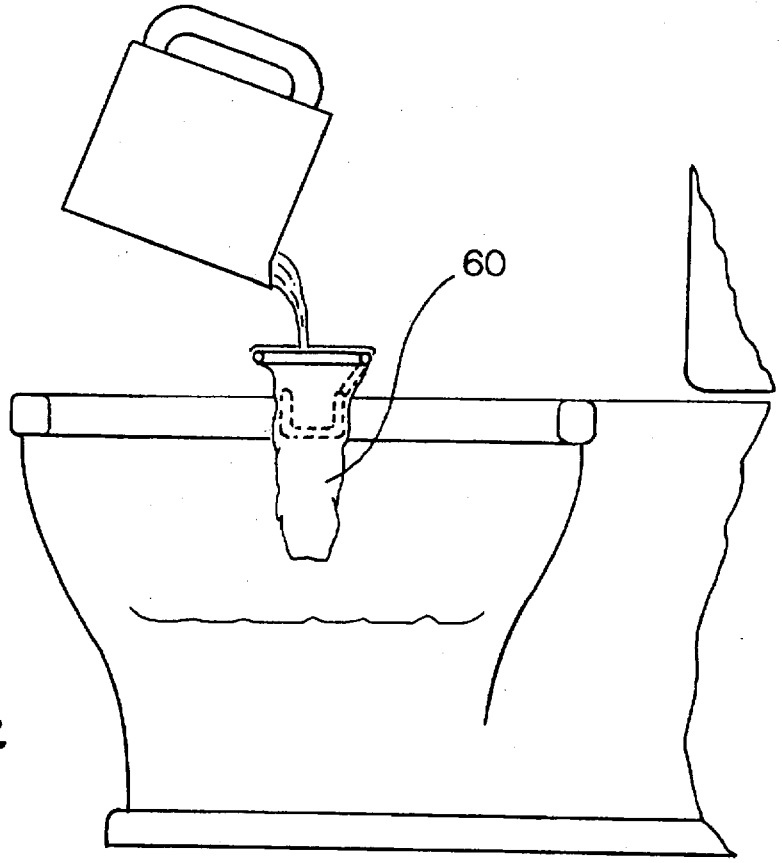
Fig. 8.

SUPPORT DEVICE FOR EMPTYING COLOSTOMY BAG

BACKGROUND OF THE INVENTION

1. Field of the Invention

The present invention relates to third hand and more particularly pertains to a device for use in supporting a colostomy bag over a toilet.

2. Description of the Prior Art

The use of disposable bag toilets is known in the prior art. More specifically, disposable bag toilets heretofore devised and utilized for the purpose of disposing of waste are known to consist basically of familiar, expected, and obvious structural configurations, notwithstanding the myriad of designs encompassed by the crowded prior art which has been developed for the fulfillment of countless objectives and requirements.

For example, U.S. Pat. No. 4,203,172 to Goncalves discloses a support for a toilet bowl deodorizer block.

U.S. Pat. No. 3,495,278 to Peters discloses a disposable bag toilet.

U.S. Pat. No. 5,265,285 to Loebbert discloses a toilet with a disposable bag.

U.S. Pat. No. 5,095,556 to Franey discloses a portable personal commode.

Lastly, U.S. Pat. No. 5,230,105 to Watson discloses a toilet seat and stand for wilderness camping.

In this respect, the third hand according to the present invention substantially departs from the conventional concepts and designs of the prior art, and in doing so provides an apparatus primarily developed for the purpose of supporting a colostomy bag over a toilet.

Therefore, it can be appreciated that there exists a continuing need for a new and improved third hand which can be used for supporting a colostomy bag over a toilet. In this regard, the present invention substantially fulfills this need.

SUMMARY OF THE INVENTION

In view of the foregoing disadvantages inherent in the known types of disposable bag toilets now present in the prior art, the present invention provides an improved third hand. As such, the general purpose of the present invention, which will be described subsequently in greater detail, is to provide a new and improved third hand and method which has all the advantages of the prior art and none of the disadvantages.

To attain this, the present invention essentially comprises a metallic wire support for use in suspending a colostomy bag over the opening of a toilet. The metallic wire support has a forward extent, a rearward extent, an upper extent and a lower extent. The support is adapted to be secured to the rim of a toilet. The support includes a first grasping end wherein the metallic wire support is formed into an upwardly disposed L-shaped extent and a downwardly disposed U-shaped extent having an opened upper extent and a closed lower extent. The upwardly disposed L-shaped extent is integral with, and formed 90 degrees relative to, the downwardly disposed U-shaped extent. A first arm is formed integral with, and extending upwardly from, the first grasping end. The support further includes a second grasping end wherein the metallic wire support is formed into an upwardly disposed L-shaped extent and a downwardly disposed U-shaped extent having an opened upper extent and a closed lower extent, the upwardly disposed L-shaped extent is integral with, and formed 90 degrees relative to, the downwardly disposed U-shaped extent. A second arm is formed integral with, and extending upwardly from, the second grasping end. Additionally, the support includes a centrally disposed circular spring having a first end, a second end and an inner periphery. The first end of the circular spring is integral with the first arm, and the second end of the circular spring is integral with the second arm. The circular spring functions such that when compression is applied to its ends the inner periphery increases. Lastly, a colostomy bag is included and has a first opened end with an outer periphery and a second closed end. The outer periphery of the colostomy bag is removably secured within the inner periphery of the circular spring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved third hand which has all the advantages of the prior art disposable bag toilets and none of the disadvantages.

It is another object of the present invention to provide a new and improved third hand which may be easily and efficiently manufactured and marketed.

It is further object of the present invention to provide a new and improved third hand which is of durable and reliable constructions.

An even further object of the present invention is to provide a new and improved third hand which is susceptible of a low cost of manufacture with regard to both materials and labor, and which accordingly is then susceptible of low prices of sale to the consuming public, thereby making such third hand economically available to the buying public.

Still yet another object of the present invention is to provide a new and improved third hand which provides in the apparatuses and methods of the prior art some of the advantages thereof, while simultaneously overcoming some of the disadvantages normally associated therewith.

Even still another object of the present invention is to enable a colostomy bag to be suspended over a toilet.

Lastly, it is an object of the present invention to provide a device which is specifically adapted to support a colostomy bag over the opening of a toilet. This device facilitates the cleaning of the bag by a user or a care giver. In its broadest context, the present invention includes a support formed from a metallic wire. This metallic wire support has a first grasping end, a second grasping end and a circular spring formed therebetween. The first grasping end is adapted to removably grasp one rim of a toilet. Oppositely positioned from the first grasping end is a second grasping end. The second grasping end is adapted to removably grasp the opposite rim of the toilet. The centrally disposed spring functions to support the upper end of a colostomy bag. Thus what has been described is a device which can support a colostomy bag over the opening of a toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a prior art disposable bag toilet.

FIG. 2 is a perspective view of a prior art support for a toilet bowl deodorizer block.

FIG. 5 is a plan view of the support.

FIG. 6 is a front elevational view of the support.

FIG. 7 is a side elevational view of the support.

FIG. 8 is a view of the support in use.

The same reference numerals refer to the same parts through the various Figures.

DESCRIPTION OF THE PREFERRED EMBODIMENT

Figure 3:
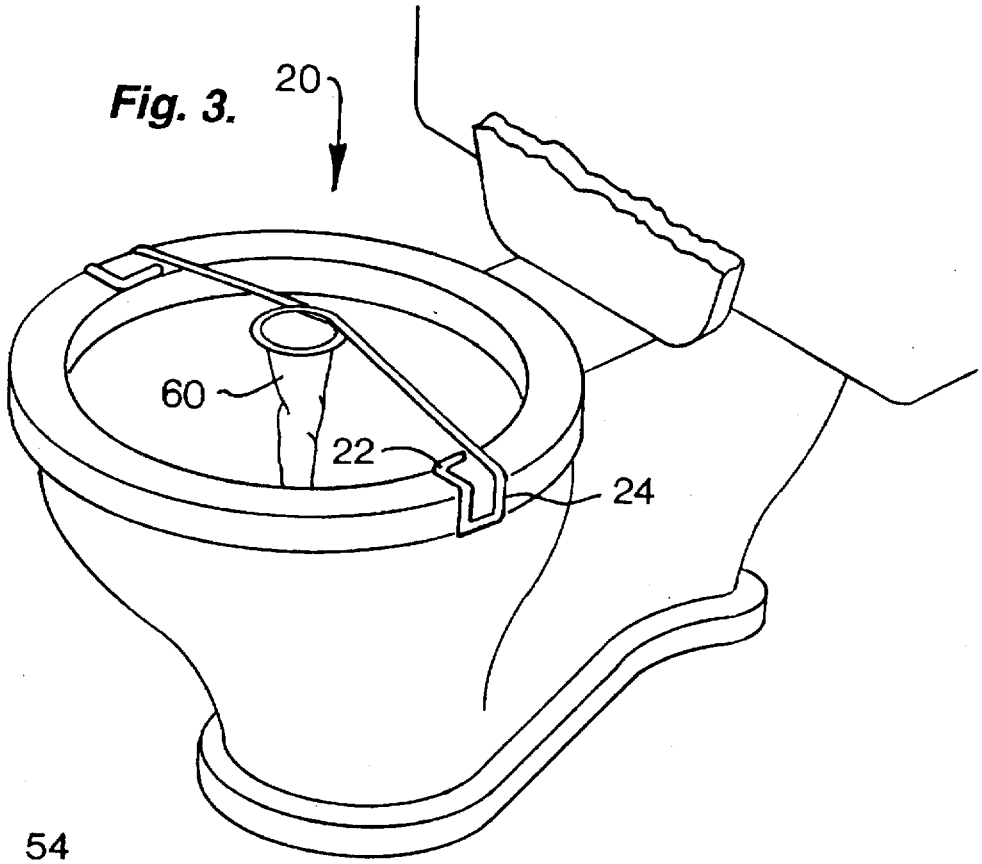
FIG. 3 is a perspective view of the support in use.
Figure 4:
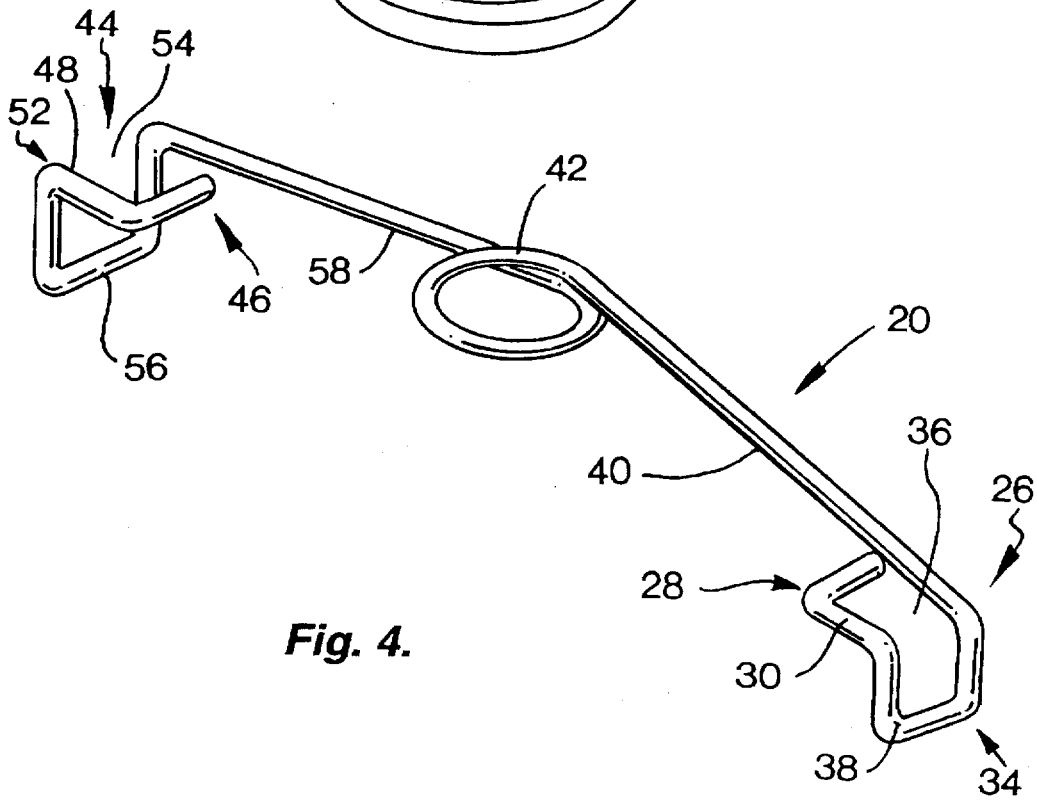
FIG. 4 is a perspective view of the support.

With reference now to the drawings, and in particular to FIG. 1 thereof, the preferred embodiment of the new and improved third hand embodying the principles and concepts of the present invention and generally designated by the reference numeral 10 will be described.

The present invention relates to a device which is specifically adapted to support a colostomy bag over the opening of a toilet. This device facilitates the cleaning of the bag by a user or a care giver. In its broadest context, the present invention includes a support formed from a metallic wire. This metallic wire support has a first grasping end, a second grasping end and a circular spring formed therebetween. The first grasping end is adapted to removably grasp one rim of a toilet. Oppositely positioned from the first grasping end is a second grasping end. The second grasping end is adapted to removably grasp the opposite rim of the toilet. The centrally disposed spring functions to support the upper end of a colostomy bag. Thus what has been described is a device which can support a colostomy bag over the opening of a toilet.

The metallic wire support 20 has a forward extent 22, a rearward extent 24, an upper extent and a lower extent. The first grasping end 26 is defined by the metallic wire support 20 being formed into an upwardly disposed and generally horizontal L-shaped extent 28 and a downwardly disposed and generally vertical U-shaped extent 34 having an opened upper extent 36 and a closed lower extent 38. The upwardly disposed L-shaped extent 28 is formed integral with, and 90 degrees relative to, the downwardly disposed U-shaped extent 34. The upwardly disposed extent 28 and downwardly disposed extent 34 in combination define a bracket adapted to be positioned over the rim of a toilet. In this orientation, the upwardly disposed L-shaped extent 28 is positioned over the rim of the toilet and the downwardly disposed U-shaped extent is positioned at the side of the toilet. The overall support 20 is integrally formed from a metallic wire which exhibits a sufficient degree of resiliency. Thus, the first grasping end 26 can be deformed a substantial degree to allow it to be fit over toilet rims of varying dimensions.

A first arm 40 is formed integrally with the first grasping end 26 of the support 20. The first arm 40 has a length which allows the support 20 to be employed on standard sized toilets. This first arm 40 extends upwardly from the first grasping end 26 at an angle of about 10 degrees as referenced with respect the upwardly disposed and generally horizontal L-shaped extent 28. The first arm is further integrally joined with the circular spring 42.

As with the first grasping end 26, the second grasping end 44 is defined by the metallic wire support 20 being formed into an upwardly disposed and generally horizontal L-shaped extent 46 and a downwardly disposed and generally vertical U-shaped extent 52 having an opened upper extent 54 and a closed lower extent 56. The upwardly disposed L-shaped extent 46 is formed integral with, and 90 degrees relative to, the downwardly disposed U-shaped extent 52. The upwardly disposed extent 46 and the downwardly disposed extent 52 in combination define a bracket adapted to be positioned over the rim of a toilet. In this orientation, the upwardly disposed L-shaped extent 52 is positioned over the outside surface of the rim of the toilet. As with the first grasping end 26, the second grasping end 44 can be deformed a substantial degree to allow it to be fit over toilet rims of various dimensions. The second end is disposed opposite the first end, and the two ends are adapted to grasp opposite sides of the toilet rim.

A second arm 58 is formed integrally with the second grasping end 44 of the support 20. The second arm 58 has a length which allows the support 20 to be employed on standard sized toilets. This second arm 58 extends upwardly from the second grasping end 44 at an angle of about 10 degrees as referenced with respect the upwardly disposed and generally horizontal L-shaped extent 46. The second arm is integrally joined with the circular spring The centrally disposed circular spring 42 has a first end, a second end and an inner periphery. The spring is essentially positioned in a plane that is parallel with the upwardly disposed and generally horizontal L-shaped extents 28 and 46. The first end of the circular spring 42 is formed integral with the first arm 40, and the second end of the circular spring is formed integral with the second arm 58. The inner periphery of the circular spring is adapted to support the opened end of a colostomy bag 60. Furthermore, the circular spring functions such that when compression is applied to it ends the inner periphery increases. Additionally, when this compression is applied the overall length of the support 20 decreases. The resilient nature of the spring is due to both the material of the support 20 and its circular, or loop, formation. The spring 42 has two effects. First, the inner periphery of the loop portion can be varied to fit various size colostomy bags. Second, the overall length of the support 20 can be varied to enable it to fit various size toilets. The colostomy bag 60 with which the support 20 is used has an opened upper end with outer periphery and a closed lower end. The outer periphery of the bag is supported by the inner periphery of the circular spring.

In operation, the first grasping end is removably secured to a portion of the toilet rim. Likewise, the second grasping end is removably secured to the toilet rim at the opposite side. Now a colostomy bag can be supported by the inner periphery of the circular spring. With the colostomy bag in this orientation, convenient washing may be accomplished. Furthermore, when the seat on the toilet is lowered, the seat is positioned in contact with the present invention, thereby increasing its stability when in use.

Thus, what has been described is a device which can be mounted on a toilet which enables colostomy patients and medical staff to empty colostomy bags in a sanitary and convenient manner. The device is made of, in the preferred embodiment, an approximately 52 inch long piece of ⅛ inch stainless steel wire. The ends of the wire are bent to form the brackets. The center of the wire is bent into a ring with an inner diameter of about 2⅜ inches. The spring is used to support a plastic flange formed at the top of the colostomy bag. The spring also allows each arm to be offset by an angle of about 45 degrees from its unbiased position without deformation occurring. The colostomy patient raises the toilet cover and seat, then places the wire device on top of the toilet bowl. The brackets at each end are securely fastened over the rim of the bowl. The colostomy bag is placed through the ring so the flange sits in the ring and hangs down into the toilet bowl. The patient opens the clip at the bottom of the bag, releasing the contents of the bag into the toilet bowl. When the bag is empty, the patient rinses it with water and pulls it out of the housing. The bag is then closed and clipped. The wire device can then be pulled off the toilet bowl rim. This device enables colostomy patients, or those who care for them, to empty colostomy bags in a safe, convenient way that is both sanitary and easy to do. It eliminates the aggravating and messy "juggling act" that many patients endure when they try to preform this unpleasant, but necessary operation. The device prevents the spread of infection and can be autoclaved for sterilization. The ring size can be adapted to different bag sizes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A metallic wire support for use in suspending a colostomy bag having an open end, over the opening of a toilet, the support adapted to be secured to the rim of a toilet having an outer side wall, the support comprising, in combination:

a first grasping end wherein the metallic wire support is formed into a first upwardly disposed L-shaped extent and a first downwardly disposed U-shaped extent having an opened upper extent and a closed lower extent, the first downwardly disposed U-shaped extent being integral with, and formed 90 degrees relative to, the first upwardly disposed L-shaped extent;

a first arm formed integral with, and extending upwardly from, the first grasping end;

a second grasping end wherein the metallic wire support is formed into a second upwardly disposed L-shaped extent and a second downwardly disposed U-shaped extent having an opened upper extent and a closed lower extent, the second downwardly disposed U-shaped extent being integral with, and formed 90 degrees relative to, the second upwardly disposed L-shaped extent;

a second arm formed integral with, and extending upwardly from, the second grasping end;

a centrally disposed circular spring having a first end, a second end and an inner periphery, the first end of the circular spring being integral with the first arm, the second end of the circular spring being integral with the second arm, the circular spring functioning such that when compression is applied to the ends the inner periphery increases;

the first grasping end adapted to be removably secured to the rim of a toilet such that the first upwardly disposed L-shaped extent is disposed over the rim of the toilet with the first downwardly disposed U-shaped extent positioned at the side of the toilet;

the second grasping end adapted to be removably secured to the rim of a toilet such that the second upwardly disposed L-shaped extent is disposed over the rim of the toilet with the second downwardly disposed U-shaped extent positioned at the side of the toilet; and the spring and the first and second arms which extend downwardly from the first and second ends, respectively, of the spring acting together, using resiliency of the spring, so as to hold the first and second grasping ends firmly against the outer side wall of the toilet rim when the support is secured thereto.

2. The support according to claim 1 wherein the inner periphery of the circular spring is sized so that when the metallic wire support is secured to the rim of the toilet, outer periphery of the open end of the colostomy bag can be removably secured to the circular spring.

3. A metallic wire support for use in suspending a colostomy bag having an open end, over an opening of a toilet, the support being adapted to be secured to the rim of the toilet having an outer side wall, the support comprising:

a centrally disposed circular spring having a first end, a second end and an inner periphery, portions of the first and second ends being disposed in overlapping relation, the circular spring extending forwardly of the overlapping portions of the first and second ends; the circular spring functioning such that when compression is applied to the ends the inner periphery increases;

a first arm formed integral with, and extending downwardly from the first end of the spring;

a second arm formed integral with, and extending downwardly from the second end of the spring;

a first grasping end wherein the metallic wire support is formed into a first extent which projects downwardly and forwardly of the first arm;

the first arm being formed integral with, and extending upwardly from the first grasping end;

a second grasping end wherein the metallic wire support is formed into a second extent which projects downwardly and forwardly of the second arm;

the second arm being formed integral with, and extending upwardly from the second grasping end;

the first grasping end being adapted to be removably secured to the rim of the toilet with the first extent positionable at the outer side wall of the toilet;

the second grasping end being adapted to be removably secured to the rim of the toilet with the second extent positionable at the outer side wall of the toilet; and the spring and the first and second arms which extend downwardly from the first and second ends, respectively, of the spring acting together, using resiliency of the spring, so as to hold the first and second grasping ends firmly against the outer side wall of the toilet rim when the support is secured thereto.

4. The support according to claim 3 wherein the inner periphery of the circular spring is sized so that when the metallic wire support is secured to the rim of the toilet, outer periphery of the open end of the colostomy bag can be removably secured to the circular spring.

* * * * *